US007474179B2

(12) United States Patent
Weister et al.

(10) Patent No.: US 7,474,179 B2
(45) Date of Patent: Jan. 6, 2009

(54) ELECTRICAL SWITCHING APPARATUS, AND MOVABLE CONTACT ASSEMBLY AND CONTACT SPRING ASSEMBLY THEREFOR

(75) Inventors: Nathan J. Weister, Darlington, PA (US); William C. Pollitt, Murrysville, PA (US); John J. Shea, Pittsburgh, PA (US); Douglas C. Marks, Murrysville, PA (US)

(73) Assignee: Eaton Corportion, Cleveland, OH (US)

( * ) Notice: Subject to any disclaimer, the term of this patent is extended or adjusted under 35 U.S.C. 154(b) by 109 days.

(21) Appl. No.: 11/549,309

(22) Filed: Oct. 13, 2006

(65) Prior Publication Data

US 2008/0088394 A1 Apr. 17, 2008

(51) Int. Cl.
*H01H 75/00* (2006.01)
*H01H 77/00* (2006.01)
*H01H 83/00* (2006.01)

(52) U.S. Cl. ..... 335/15; 335/6; 335/8; 335/12; 335/16; 335/46; 335/73; 335/106; 335/190; 335/191; 335/192; 335/193; 335/194; 335/195; 335/196; 200/244; 200/261; 200/472; 200/542; 200/574; 200/416

(58) Field of Classification Search ..... 335/6, 335/8, 12, 15, 16, 46, 73, 106, 190–196; 200/244, 261, 416, 472, 542, 574
See application file for complete search history.

(56) References Cited

U.S. PATENT DOCUMENTS 3,808,386 A * 4/1974 Strobel ..... 200/401
4,887,057 A 12/1989 Gula et al.
4,891,618 A * 1/1990 Paton ..... 335/195
5,200,724 A 4/1993 Gula et al.
5,260,533 A * 11/1993 Livesey et al. ..... 200/401
5,793,270 A * 8/1998 Beck et al. ..... 335/16
5,874,874 A * 2/1999 Helms et al. ..... 335/16
5,899,323 A 5/1999 Rakus
6,005,206 A 12/1999 Rakus et al.
6,570,116 B2 5/2003 Maulandi et al.
6,977,568 B1 12/2005 Rakus et al.
7,034,642 B1 4/2006 Rakus et al.
7,189,935 B1 * 3/2007 Hassan et al. ..... 200/244
2005/0231308 A1 * 10/2005 Kim ..... 335/16
2006/0077022 A1 * 4/2006 Kim ..... 335/16

* cited by examiner

*Primary Examiner*—Elvin G Enad
*Assistant Examiner*—Mohamad A Musleh
(74) *Attorney, Agent, or Firm*—Charles E. Kosinski; Martin J. Moran

(57) ABSTRACT

A contact spring assembly is provided for an electrical switching apparatus including a movable contact assembly and a stationary contact assembly having stationary electrical contacts. The movable contact assembly includes a carrier assembly, and movable contact arms pivotably coupled to the carrier assembly and carrying movable electrical contacts. The contact spring assembly includes a first contact spring housing member, a second contact spring housing member coupled to and disposed opposite from the first contact spring housing member, a spring guide disposed between and coupled to at least one of the first and second contact spring housing members and including spring holes, springs received in the spring holes, and sliders coupled to the springs. The springs and sliders individually bias the movable contact arms and movable electrical contacts toward engagement with corresponding stationary electrical contacts. A movable contact assembly and an electrical switching apparatus are also disclosed.

10 Claims, 5 Drawing Sheets

ELECTRICAL SWITCHING APPARATUS, AND MOVABLE CONTACT ASSEMBLY AND CONTACT SPRING ASSEMBLY THEREFOR

CROSS-REFERENCE TO RELATED APPLICATIONS

This application is related to commonly assigned, concurrently filed:

U.S. patent application Ser. No. 11/549,316, filed Oct. 13, 2006, entitled "ELECTRICAL SWITCHING APPARATUS, AMD CARRIER ASSEMBLY AND INDEPENDENT PIVOT ASSEMBLY THEREFOR";

U.S. Pat. No. 7,351,927, issued Apr. 1, 2008 entitled "ELECTRICAL SWITCHING APPARATUS, AND CONDUCTOR ASSEMBLY, AND INDEPENDENT FLEXIBLE CONDUCTIVE ELEMENTS THEREFOR"; and U.S. patent application Ser. No. 11/549,294, filed Oct. 13, 2006, entitled "ELECTRICAL SWITCHING APPARATUS, AND HOUSING AND INTEGRAL POLE SHAFT BEARING ASSEMBLY THEREFOR", all of which are hereby incorporated herein by reference.

BACKGROUND OF THE INVENTION (1)Field of the Invention

The invention relates generally to electrical switching apparatus and, mare particularly, to electrical switching apparatus, such as circuit breakers, having contact spring assemblies.The invention also relates to contact spring assemblies for circuit breaker movable contact assemblies.

(2) Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current trough the conductors of an electrical system in response to such fault conditions.

Many low-voltage circuit breakers, for example, employ a molded housing having two parts, a first half or front part (e.g., a molded cover), and a second half or rear part (e.g., a molded base). The operating mechanism for such circuit breakers is often mounted to the front part of the housing, and typically includes an operating handle and/or button(s) which, at one end, is (are) accessible from the exterior of the molded housing and, at the other end, is (are) coupled to a pivotable pole shaft. Electrical contact assemblies, which are also disposed within the molded housing, generally comprise a conductor assembly including a movable contact assembly having a plurality of movable contacts, and a stationary contact assembly having a plurality of corresponding stationary contacts. The movable contact assembly is electrically connected to a generally rigid conductor of the conductor assembly by flexible conductors, commonly referred to as shunts. The movable contact assembly includes a plurality of movable contact arms or fingers, each carrying one of the movable contacts and being pivotably coupled to a contact arm carrier. The contact arm carrier is pivoted by a protrusion or arm on the pole shaft of the circuit breaker operating mechanism to move the movable contacts into and out of electrical contact with the corresponding stationary contacts of the stationary contact assembly. The contact arm carrier includes a contact spring assembly structured to bias the fingers of the movable contact assembly against the stationary contacts of the stationary contact assembly in order to provide and maintain contact pressure when the circuit breaker is closed, and to accommodate wear.

More specifically, some low-voltage power circuit breakers require contact pressure to be maintained during operation, in order to achieve the desired thermal and interruption performance. To provide such pressure, it has been known to employ contact spring assemblies which are coupled to the contact arm carrier and structured to bias the contact arms or fingers, and the movable contacts disposed thereon, toward the stationary contacts. See, e.g., U.S. Pat. Nos. 6,005,206 and 6,977,568, which are hereby incorporated herein by reference.

Among the disadvantages of such contact spring assemblies is that they are relatively complex in design, employing a relatively large number of springs (e.g., at least one set of eight or more springs), and comprising a unit which is separate from, and disposed beside (i.e., behind and/or adjacent to), the contact arm carrier. As a result, the contact spring assembly not only consumes valuable space within the circuit breaker housing, it is also relatively difficult to assemble. Moreover, the large size and inconvenient location of the contact spring assembly reduces the dimension within the circuit breaker housing which is available to accommodate the motion of the movable contact assembly during the various stages (e.g., opening; closing; tripping open in response to a fault condition) of its operation. It also adds mass, which decreases the opening velocity of the movable contact assembly, thus adversely affecting the circuit interruption performance of the circuit breaker. A still further disadvantage is the fact that contact pressure is not provided separately to each individual contact arm or finger of the movable contact assembly. Rather, the springs of known contact assemblies bias a common element (e.g., a cam element) which engages all of the fingers simultaneously.

It is desirable, therefore, to provide a contact spring assembly which provides accurate and consistent contact pressure to the individual fingers or contact arms of the movable contact assembly, and which allows independent contact arm movement while being tolerant of manufacturing variation, cost-effective to manufacture, compact in size, and relatively easy to assemble.

There is, therefore, room for improvement in contact spring assemblies for the movable contact assemblies of electrical switching apparatus such as, for example, low-voltage circuit breakers.

SUMMARY OF THE INVENTION

These needs and others are met by embodiments of the invention, which are directed to a contact spring assembly for the movable contact assembly of an electrical switching apparatus, such as a low-voltage circuit breaker.

As one aspect of the invention, a contact spring assembly is provided for an electrical switching apparatus including a movable contact assembly and a stationary contact assembly having a plurality of stationary electrical contacts. The movable contact assembly may include a carrier assembly, a plurality of movable contact arms pivotably coupled to the carrier assembly, and a plurality of movable electrical contacts coupled to the movable contact arms. The movable contact arms are movable into and out of electrical contact with the stationary electrical contacts of the stationary contact assembly. The contact spring assembly comprises: a first contact spring housing member; a second contact spring housing member coupled to the first contact spring housing member and being disposed opposite the first contact spring housing member; a spring guide including a plurality of spring holes, the spring guide being coupled to at least one of the first contact spring housing member and the second contact spring housing member and being disposed between the first contact spring housing member and the second contact spring housing member; a plurality of sliders; and a plurality of springs, each of the springs having a first end received by a corresponding one of the spring holes of the spring guide, and a second end coupled to a corresponding one of the sliders. Each of the springs and the corresponding one of the sliders coupled thereto is structured to individually bias a corresponding one of the movable contact arms of the movable contact assembly and a corresponding one of the movable electrical contacts coupled thereto towards engagement with a corresponding one of the stationary electrical contacts of the stationary contact assembly.

The first and second contact spring housing members may be substantially identical, and they may each comprise at least one protrusion and at least one aperture, wherein the first contact spring housing member and the second contact spring housing member are positioned in order that the protrusion of the first contact spring housing member engages the aperture of the second contact spring housing member, and the protrusion of the second contact spring housing member engages the aperture of the first contact spring housing member, thereby securing the contact spring assembly together.

The sliders may comprise a first end coupled to the second end of one of the springs and a second end comprising a cam element which is structured to engage and move the corresponding one of the movable contact arms of the movable contact assembly. The first and second contact spring housing members may each include a plurality of elongated guide slots, and the sliders may further comprise a first side including a first protrusion and a second side including a second protrusion, wherein the first and second protrusions are structured to engage an opposing pair of the elongated guide slots of the first and second contact spring housing members, in order to guide the sliders and the cam elements toward engagement with the movable contact arms.

As another aspect of the invention, a movable contact assembly is provided for an electrical switching apparatus including a stationary contact assembly having a plurality of stationary electrical contacts. The movable contact assembly comprises: a first carrier member; a second carrier member; a plurality of movable contact arms pivotably coupled between the first carrier member and second carrier member; a plurality of movable electrical contacts coupled to the movable contact arms and being movable into and out of electrical contact with the stationary electrical contacts of the stationary contact assembly; and a contact spring assembly comprising: a first contact spring housing member, a second contact spring housing member coupled to the first contact spring housing member and being disposed opposite the first contact spring housing member, a spring guide including a plurality of spring holes, the spring guide being coupled to at least one of the first contact spring housing member and the second contact spring housing member, and being disposed between the first contact spring housing member and the second contact spring housing member, a plurality of sliders, and a plurality of springs, each of the springs having a first end received by a corresponding one of the spring holes of the spring guide, and a second end coupled to a corresponding one of the sliders, wherein each of the springs and the corresponding one of the sliders coupled thereto individually biases a corresponding one of the movable contact arms of the movable contact assembly and a corresponding one of the movable electrical contacts coupled thereto towards engagement with a corresponding one of the stationary electrical contacts of the stationary contact assembly.

The movable contact arms may have an axis of rotation, wherein the contact spring assembly is disposed above and behind the axis of rotation in order to provide the springs of the contact spring assembly with a mechanical advantage and to provide consistent spring force to the movable contact arms.

As another aspect of the invention, an electrical switching apparatus comprises: a stationary contact assembly including a plurality of stationary electrical contacts; and a movable contact assembly comprising: a first carrier member, a second carrier member, a plurality of movable contact arms pivotably coupled between the first carrier member and second carrier member, a plurality of movable electrical contacts coupled to the movable contact arms and being movable into and out of electrical contact with the stationary electrical contacts of the stationary contact assembly, and a contact spring assembly comprising: a first contact spring housing member, a second contact spring housing member coupled to the first contact spring housing member, and being disposed opposite the first contact spring housing member, a spring guide including a plurality of spring holes, the spring guide being coupled to at least one of the first contact spring housing member and the second contact spring housing member, and being disposed between the first contact spring housing member and the second contact spring housing member, a plurality of sliders, and a plurality of springs, each of the springs having a first end received by a corresponding one of the spring holes of the spring guide, and a second end coupled to a corresponding one of the sliders, wherein each of the springs and the corresponding one of the sliders coupled thereto individually biases a corresponding one of the movable contact arms of the movable contact assembly and a corresponding one of the movable electrical contacts coupled thereto towards engagement with a corresponding one of the stationary electrical contacts of the stationary contact assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
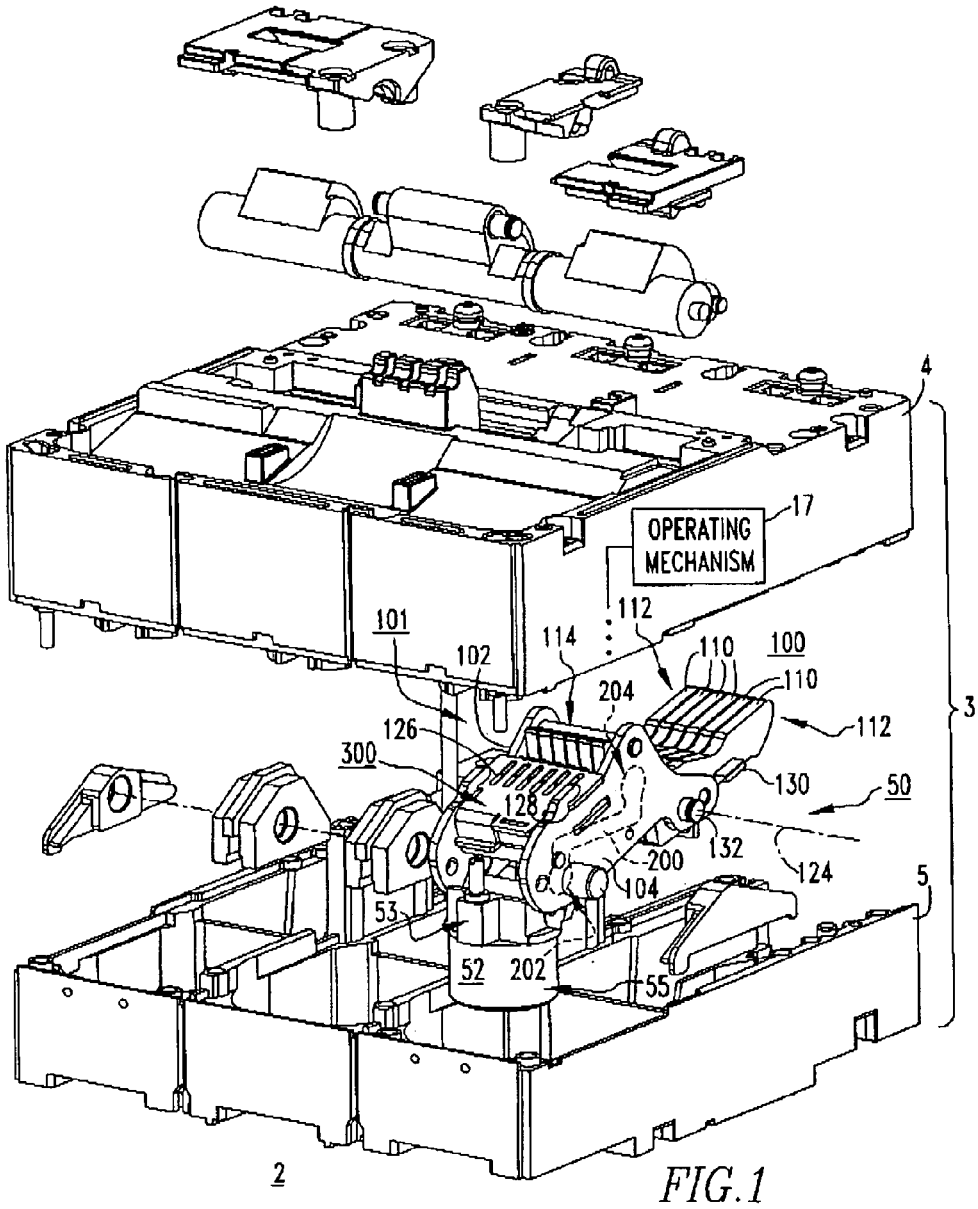
FIG. 1 is an exploded isometric view of a low-voltage circuit breaker and one of the conductor assemblies therefor.

For purposes of illustration, embodiments of the invention will be described as applied to a contact spring assembly for the movable contact assembly of a low-voltage circuit breaker, although it will become apparent that they could also be applied to any known or suitable electrical switching apparatus (e.g., without limitation, circuit switching devices and circuit interrupters such as circuit breakers other than low-voltage circuit breakers, network protectors, contactors, motor starters, motor controllers and other load controllers).

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a low-voltage circuit breaker 2 including a housing 3 which encloses a conductor assembly 50 having a movable contact assembly 100 with flexible conductive elements 200 (one flexible element 200 is shown in hidden line drawing in simplified form in FIG. 1), in accordance with embodiments of the invention. The housing 3 includes a first half or front part 4 (e.g., a molded cover) and a second half or back part 5 (e.g., a molded base), with the conductor assembly 50 being disposed therebetween. The low-voltage circuit breaker 2 further includes first and second conductors such as the example line and load conductors 6,8 partially shown in phantom line drawing in simplified form in FIG. 3.

Figure 2:
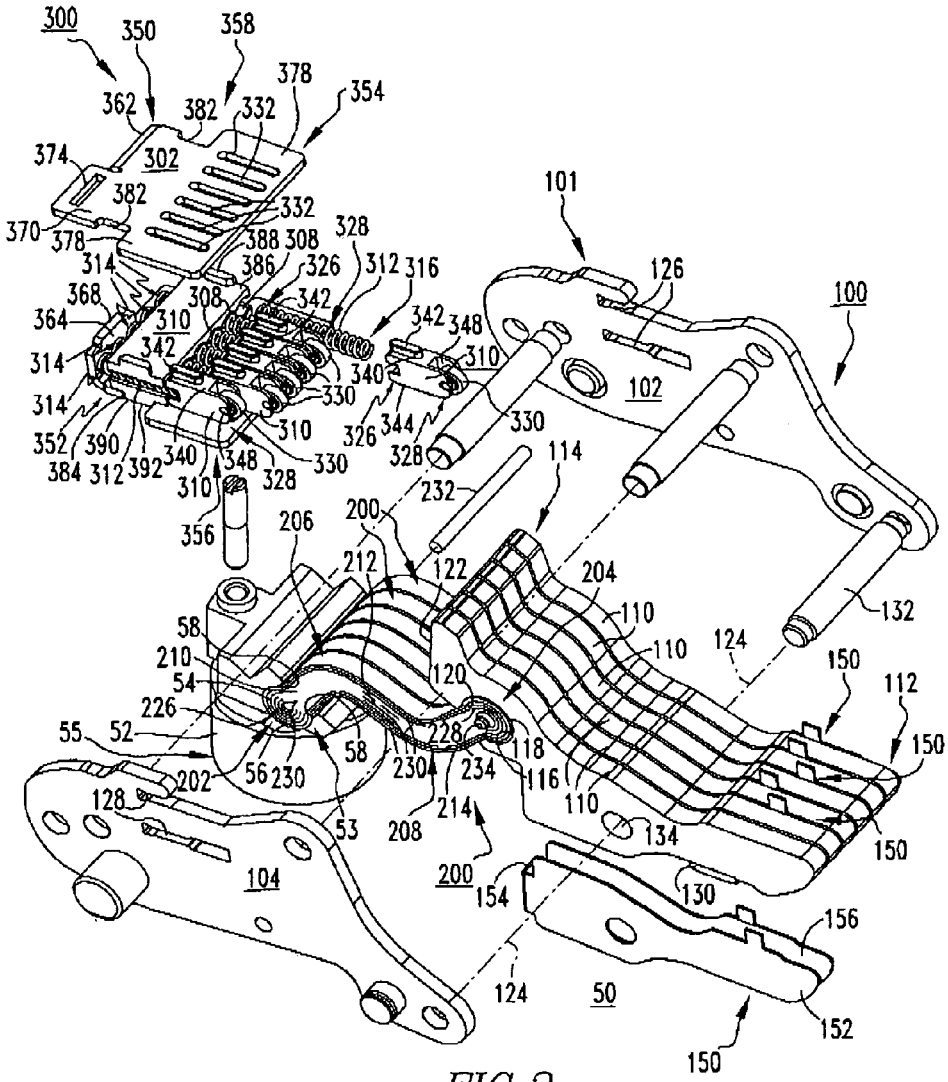
FIG. 2 is an exploded isometric view of the conductor assembly of FIG. 1, including a contact spring assembly in accordance with an embodiment of the invention.
Figure 3:
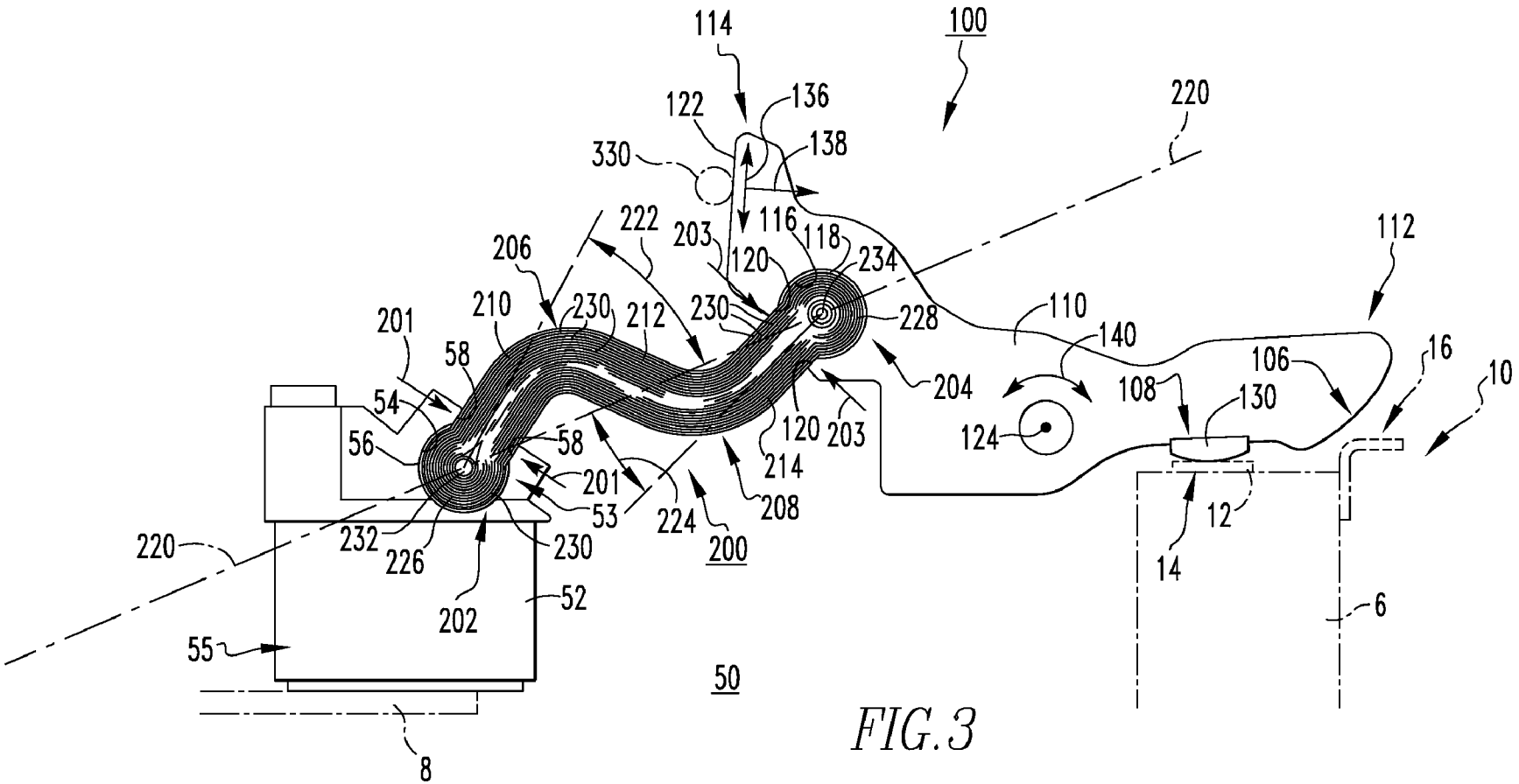
FIG. 3 is a side elevational view of a portion of the conductor assembly of FIG. 2, without the contact spring assembly.

As shown in FIGS. 2 and 3, the conductor assembly 50 includes a load conductor 52, a movable contact assembly 100, and a plurality of the flexible conductive elements 200 electrically connecting the load conductor 52 and the movable contact assembly 100. The movable contact assembly 100 includes a plurality of movable contact arms 110. Each of the movable contact arms 110 has a first end 112 and a second end 114. A movable electrical contact 130 is coupled to each movable contact arm 110 at or about the first end 112 thereof, and is structured to move into and out of electrical contact with a corresponding stationary electrical contact 12 (FIG. 3) of the low-voltage circuit breaker 2 (FIG. 1). Specifically, as shown in FIG. 3, the first electrical conductor or line conductor 6 of the circuit breaker 2 (FIG. 1) includes a stationary contact assembly 10 (shown in phantom line drawing in simplified form) having a plurality of stationary electrical contacts 12 (one stationary electrical contact 12 is shown in FIG. 3).

When the conductor assembly 50 is assembled within the circuit breaker housing 3 (FIG. 1) the load conductor 52 is in electrical contact with the second electrical conductor or load conductor 8 of the circuit breaker 2 and the movable electrical contact 130 is movable into (FIG. 3) and out of (not shown) electrical contact with the corresponding stationary electrical contact 12 of the stationary contact assembly 10. It will be appreciated that, for simplicity of illustration, only one conductor assembly 50 is shown in the figures. Typically, however, the low-voltage circuit breaker 2, shown in FIG. 1, which is a three-pole circuit breaker 2, would include three such conductor assemblies 50, one for each of the poles of the circuit breaker 2. It will further be appreciated that the conductor assembly 50 could be employed with any known or suitable electrical switching apparatus having any number of poles other than the three-pole low-voltage circuit breaker 2 shown and described in connection with FIG. 1.

Referring to FIGS. 2 and 3, each of the flexible conductive elements 200 which electrically connect the load conductor 52 of the conductor assembly 50 to the movable contact assembly 100, includes a first end 202 structured to be electrically connected to the load conductor 52, a second end 204 structured to be electrically connected to a corresponding one of the movable contact arms 110 of the movable contact assembly 100, and a plurality of bends 206,208 between the first end 202 and the second end 204. As best shown in FIG. 3, a first one of the bends 206 is in a first direction and at least a second one of the bends 208 is in a second direction which is generally opposite the first direction of the first bend 206. More specifically, the example flexible conductive element 200 is a shunt comprising layered conductive ribbon 230 (shown exaggerated in FIGS. 2 and 3 for ease of illustration), and includes two bends 206,208, a first bend 206 in the first direction, and a second bend 208 in the second direction in order that the shunt 200 is generally S-shaped. Accordingly, the shunt 200 includes a first portion 210 disposed between the first end 202 and the first bend 206, a second portion 212 disposed between first bend 206 and second bend 208, and a third portion 214 disposed between second bend 208 and the second end 204 of the shunt 200. The generally S-shape configuration of the shunt 200 permits it to have a relatively low profile in a vertical direction, thus minimizing the amount of space required for the conductor assembly 50 within the circuit breaker housing 2 (FIG. 1).

An axis 220 extends between the first end 202 of the shunt 200 and the second end 204 of the shunt 200. The first portion 210 of the shunt 200 forms a first angle 222 with respect to axis 220 on one side of the axis, and the third portion 214 of the shunt 200 forms a second angle 224 with respect to the axis 220, on the opposite side of the axis 220. Preferably the first and second angles 222,224 of the first and third portions 210,214 of shunt 200, are different. For example, the first angle 222 of the shunt 200 of FIG. 3 is greater than second angle 224. By way of a non-limiting example, the first angle 222 of the example shunt 200 is between about 26 degrees and about 36 degrees with respect to axis 220, and the second angle 224 is between about 11 degrees and about 22 degrees. It will, however, be appreciated that any known or suitable shunt configuration could be employed in accordance with embodiments of the invention to accommodate the compound motion of the conductor assembly 50 while minimizing areas of stress concentration in the shunts 200 and providing a compact shunt design. It will also be appreciated that while the shunt 200 is contemplated as being made from wound layered conductive ribbon 230 which is made of copper, that any known or suitable electrically conductive material could alternatively be employed without departing from the scope of the invention. Likewise, while the example shunt 200 has about 58 layers of conductive ribbon 230, a width of about 0.35 inches, a length of about 2.2 inches (measured from the center of the first end 202 of shunt 200 to the center of the second end 204 thereof), an overall thickness of about 0.187 inches, and a ribbon layer thickness of about 0.003 inches, it will be appreciated that one or more of these dimensions could be changed to any known or suitable value as necessary for the particular application in which the shunt 200 will be used.

Continuing to refer to FIGS. 2 and 3, the load conductor 52 of the conductor assembly 50 comprises a solid conductor 52 having a first portion 53 and a second portion 55 generally opposite the first portion 53. The first portion 53 includes a first aperture which generally comprises a single elongated recess 54 (best shown in FIG. 2). The single elongated recess 54 receives the first ends 202 of all of the shunts 200. The second ends 204 of the shunts 200 are received in corresponding second apertures 116 in the second ends 114 of each of the movable contact arms 110 (six shunts 200 are shown in FIG. 2). More specifically, the first end 202 of each shunt 200 comprises a first generally round head 226 and the second end 204 of the shunt 200 comprises a second generally round head 228. The single elongated recess 54 of the load conductor 52 and the second aperture 116 of the corresponding movable contact arms 110 each comprise an interior arcuate portion 56,118 and a neck portion 58,120, respectively, as shown. The first generally round head 226 of the first end 202 of shunt 200 is disposed within the interior arcuate portion 56 of the first aperture or single elongated recess 54 of the load conductor 52, as shown, and the neck portion 58 of the first aperture 54 is compressed against shunt 200 in the direction indicated by arrows 201 of FIG. 3 in order to retain the first end 202 of the shunt 200 within the first aperture 54. Similarly, the second generally round head 228 is disposed within the second aperture 116 of the corresponding movable contact arm 110, and the second end 204 of the shunt 200 is retained within the interior arcuate portion 118 of the second aperture 116. Such retention can be provided by the neck portion 120 of the second aperture 116 being compressed against the shunt 200 in the direction generally indicated by arrows 203 of FIG. 3, but may further or alternatively be provided by a pin 234 being inserted through the round head 228 (discussed hereinbelow) and then swaged or peened to expand the layers of conductive ribbon 230 of the second end 204 radially outward against the interior arcuate portion 118 of the second aperture 116.

For each of the example shunts 200, the first and second generally rounds heads 226,228 of the first and second ends 202,204 further include first and second pins 232,234 disposed through the center of the-heads 226,228 within the first and second apertures 54,116, respectively. More specifically, the layers of conductive ribbon 230 of the shunt 200 wrap around the first and second pins 232,234 within the first and second apertures 54,116, respectively, of the load conductor 52 and the corresponding movable contact arm 110, respectively, as shown in FIG. 3.

In FIG. 2, the first pin 232 is shown before being inserted through the center of the first generally round head 226 of each of the shunts 200 within the interior arcuate portion 56 of the single elongated recess 54 of the load conductor 52.

Accordingly, it will be appreciated that the first and second ends 202,204 of the shunts are secured within the first and second apertures 54,116, respectively, of the load conductor 52 and the corresponding movable contact arms 210. This may be accomplished by, for example and without limitation, swaging or crimping a portion (e.g., neck portion 58) of the load conductor 52 adjacent the first aperture 54, and a portion (e.g., neck portion 120) of the corresponding movable contact arm 110 adjacent the second aperture 116 against the first and second ends 202,204 of the shunts 200, respectively, or by any other known or suitable fastening process or mechanism, such as, for example, a rivet 232,234 (e.g., a staked or suitably deformed pin), solder, brazing, or any suitable combination thereof.

As best shown in FIG. 2, the movable contact assembly 100 may further include a plurality of spacers 150 structured to separate the movable contact arms 110 of the assembly 100 from one another. Specifically, each of the spacers 150 includes a first portion 152, a connection portion 154, and a second portion 156 spaced opposite from the first portion 152, as shown. Each of the movable contact arms 110 of the movable contact assembly 100 is disposed between the first and second portions 152,156 of one of the spacers 150, thereby separating one movable contact arm 110 from at least one other movable contact arm 110 of the movable contact assembly 100. The spacers 150 maybe made from any known or suitable material, such as, for example and without limitation, vulcanized fiber material, commonly referred to as fish paper. It will be appreciated that the spacers 150 may, but need not necessarily, also serve to electrically and/or thermally insulate the movable contact arms 110 of the assembly 100 from one another.

In addition to the aforementioned flexible conductive members 200, FIG. 2 also shows a contact spring assembly 300 for the movable contact assembly 100 of conductor assembly 50. The movable contact assembly 100, previously discussed, further includes opposing first and second carrier members 102,104 which secure the movable contact arms 110 therebetween, thus comprising a carrier assembly 101. The contact spring assembly 300 is coupled to at least one of the first and second carrier members 102,104, and is disposed between the first and second carrier members 102,104 proximate the second ends 114 of the movable contact arms 110.

Referring to FIGS. 2, 4, 5, 6A, and 6B, the contact spring assembly 300 includes a first contact spring housing member 302 and a second contact spring housing member 304 coupled to the first contact spring housing member 302 and disposed opposite therefrom. A spring guide 306 is coupled to at least one of the first and second contact spring housing members 302,304, and is disposed therebetween. The spring guide 306 includes a plurality of spring holes 308 each structured to receive a corresponding spring 312. Specifically, each spring 312 has a first end 314, which is received by a corresponding one of the spring holes 308 of spring guide 306, and a second end 316, which is coupled to a corresponding slider 310 (best shown in FIGS. 2 and 5). Each of the springs 312 and sliders 310 coupled thereto is structured to individually bias a corresponding one of the movable contact arms 110 (FIGS. 1-4) of the movable contact assembly 100 (FIGS. 1-4) and the movable electrical contact 130 (FIGS. 1-3) coupled thereto towards engagement with a corresponding one of the stationary electrical contacts 12 (FIG. 3) of the stationary contact assembly 10 (FIG. 3).

The example first and second contact spring housing members 302,304 are substantially identical. Thus, the number of components which must be manufactured for the contact spring assembly 300 is reduced, thereby reducing the associated manufacturing costs. Additionally, the substantially identical first and second contact spring housing members 302,304 enable the contact spring assembly 300 to be secured together without requiring the use of conventional mechanical fasteners (e.g., without limitation, screws; rivets; bolts and nuts), as will be discussed in greater detail herein below.

Figure 4:
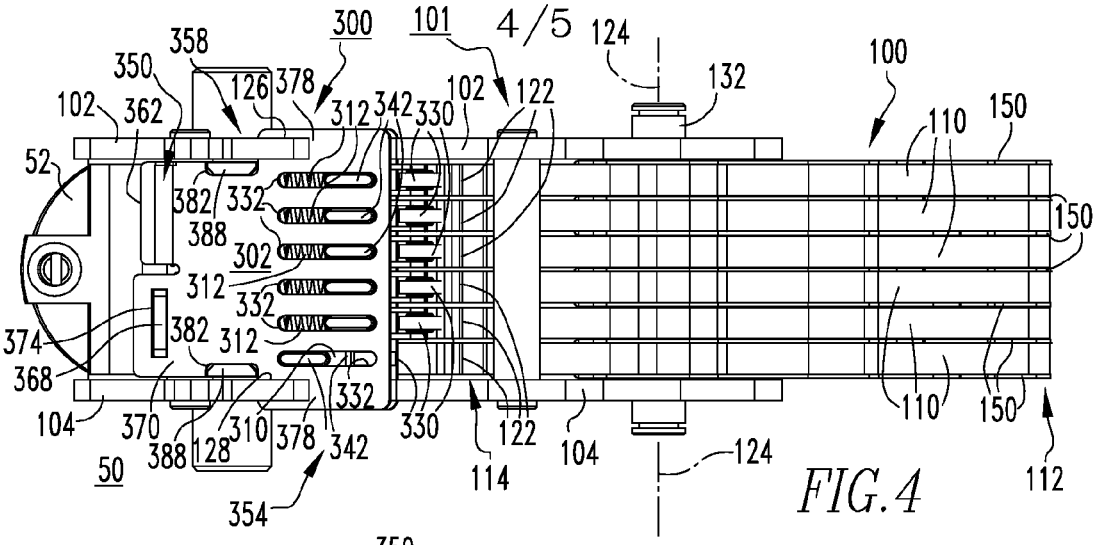
FIG. 4 is an assembled top plan view of the conductor assembly and contact spring assembly of FIG. 2.
Figure 5:
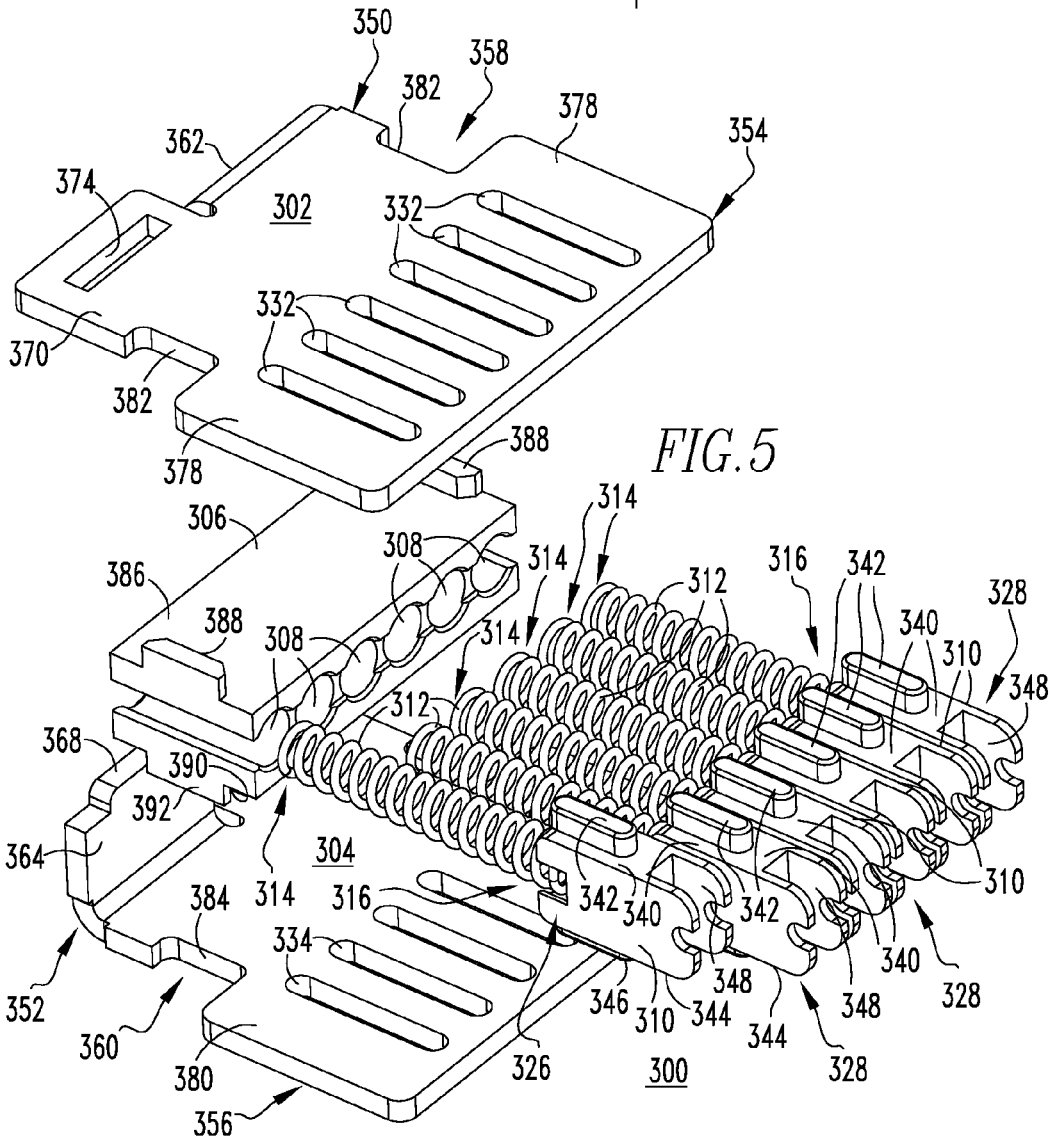
FIG. 5 is an exploded isometric view of the contact spring assembly of FIG. 2.

As shown in FIGS. 2 and 5, the example contact spring assembly 300 includes six springs 312 which are received in six corresponding spring thru holes 308 of the spring guide 306. The thru holes 308 (best shown in FIG. 5) extend completely through the spring guide 306, in order to receive the first ends 314 of the springs 312. As previously discussed, the second ends 316 of the springs 312 are coupled to individual sliders 310. Each slider 310 includes a first end 326 coupled to the second end 316 of a corresponding one of the springs 312, and a second end 328 comprising a cam element such as the rollers 330, best shown in FIGS. 2 and 4. Each of the cam elements 330 (FIGS. 2 and 4) is structured to engage and move a corresponding one of the movable contact arms 110 of the movable contact assembly 100.

Figure 6A:
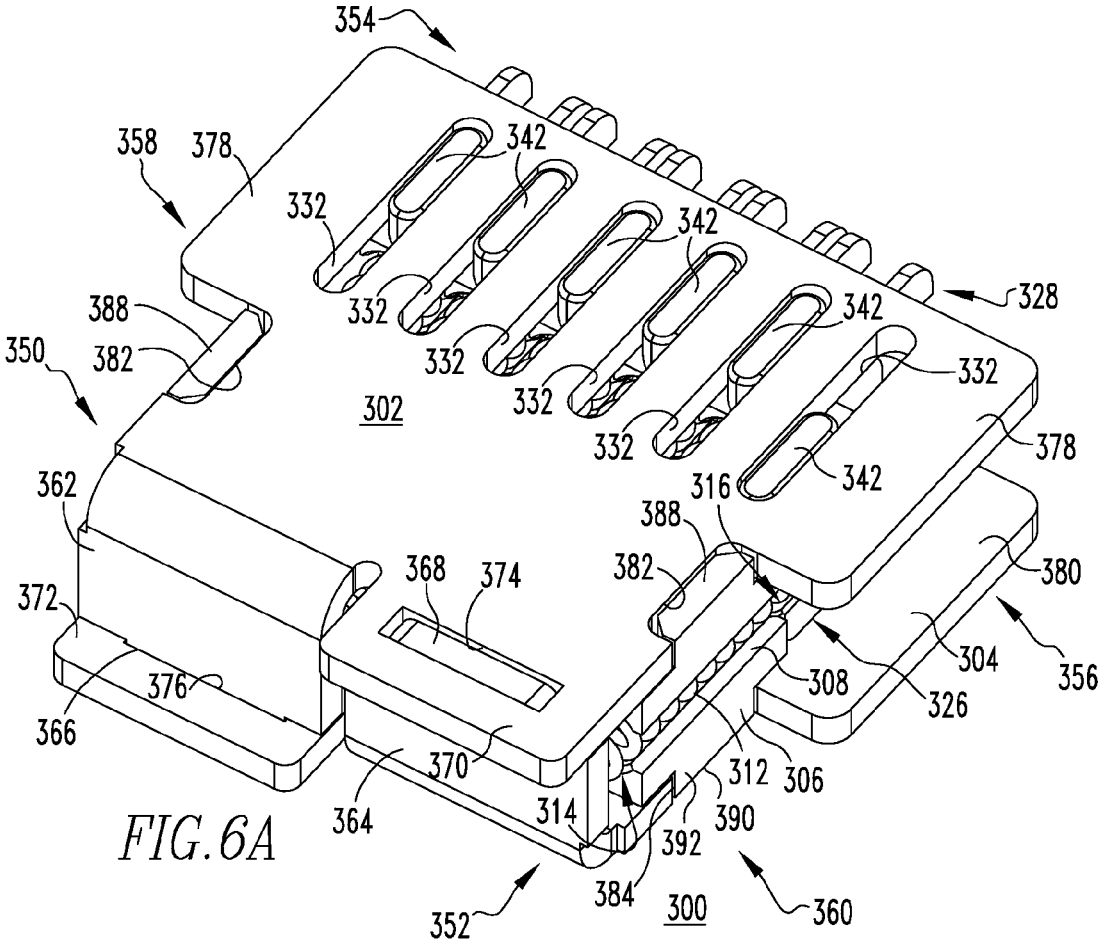
FIG. 6A is an assembled top isometric view of the contact spring assembly of FIG. 5.
Figure 6B:
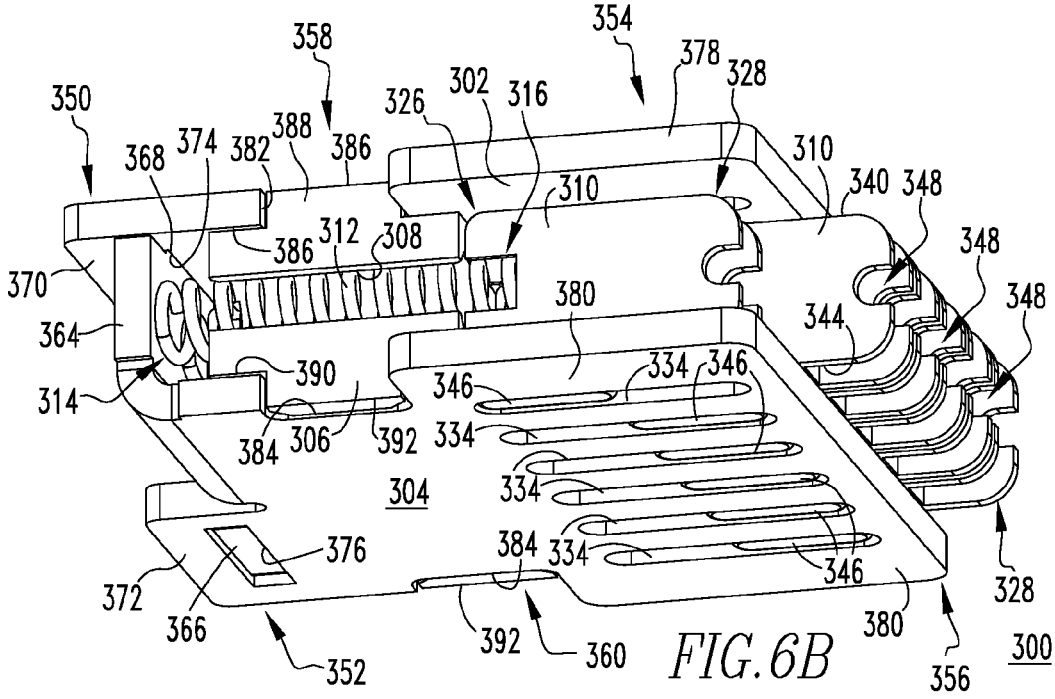
FIG. 6B is an assembled bottom isometric view of the contact spring assembly of FIG. 5.

Referring to FIGS. 5, 6A and 6B, the first and second contact spring housing members 302,304 of the contact spring assembly 300 each include a plurality of elongated guide slots 332,334 for receiving first and second protrusions 342,346 on the first and second sides 340,344 of each slider 310. Specifically, the first and second protrusions 342,346 engage an opposing pair of the elongated guide slots 332,334 of the first and second spring housing members 302,304, respectively, in order to guide the slider 310 and cam element 330 (FIGS. 2 and 4) towards engagement with the corresponding movable contact arm 110 (FIGS. 2 and 4). For example, in FIG. 4, five of the cam elements 330 are extended and engaging the second ends 114 of corresponding movable contact arms 110 of the movable contact assembly 100. The sixth cam element 330 is retracted, as indicated by the position of the first protrusion 342 of slider 310 within the first guide slot 332 of the first contact spring housing member 302. Accordingly, it will be appreciated that the cam elements 330 (FIGS. 2 and 4) of the contact spring assembly 300 in accordance with embodiments of the invention individually engage and bias a corresponding movable contact arm 110 (FIGS. 2 and 4) independent from the remainder of the cam elements 330 (FIGS. 2 and 4) of the contact spring assembly 300. It will be appreciated that the cam elements 330 can comprise any known or suitable bearing element, such as the small wheel 330 shown in FIG. 2, which is pivotably disposed within a recess 348 at the second end 328 of slider 310.

As previously noted, the contact spring assembly 300 is secured together and to the carrier assembly 101 (FIG. 2), without requiring the use of separate mechanical fasteners. More specifically, as best shown in FIGS. 5, 6A and 6B, the first and second contact spring housing members 302,304 each include at least one protrusion 366,368 and at least one aperture 374,376, wherein the first and second contact spring housing members 302,304 are positioned in order that the protrusion 366,368 of one of the first and second contact spring carrier members 302,304 engages the aperture 374, 376 of the other of the first and second contact spring carrier member 302,304, respectively, thereby securing the contact spring assembly 300 together. More specifically, the first and second contact spring housing members 302,304 each include a first end 350,352 and a second end 354,356, respectively. The first end 350,352 includes a folded tab 362,364 including the protrusion 366,368, and an unfolded tab 370, 372 having the aperture 374,376. The relationship between the first and second contact spring housing members 302,304 which, as previously discussed, are substantially identical, can best be appreciated with reference to the front and back isometric views of the contact spring assembly 300 shown in FIGS. 6A and 6B, respectively. Specifically, protrusion 366 of the folded tab 362 of the first end 350 of first contact spring housing member 302 engages the aperture 376 of the unfolded tab 372 of the first end 352 of second contact spring housing member 304, and protrusion 368 of the folded tab 364 of the first end 352 of second contact spring housing member 304 engages the aperture 374 of the unfolded tab 370 of the first end 350 of first contact spring housing member 302.

The second ends 354,356 of the first and second contact spring housing members 302,304 each comprise a pair of lateral protrusions 378,380 which, as best shown in FIGS. 2 and 4, are structured to engage corresponding slots 126,128 in the first and second carrier members 102,104 of the carrier assembly 101 of movable contact assembly 100. More specifically, the pair of lateral protrusions 378,380 of the second end 354,356 of one of the first and second contact spring housing members 302,304 engages corresponding slots 126, 128 in the first and second carrier members 102,104, respectively, of the carrier assembly 101, thereby securely coupling the contact spring assembly 300 to the movable contact assembly 100, without the use of separate mechanical fasteners.

The first and second contact spring housing members 302, 304 also include an intermediate portion 358,360 having a pair of recesses 382,384, respectively. The recesses 382,384 are engaged by corresponding first and second pairs of protrusions 388,392 on the first and second sides 386,390, respectively, of the spring guide 306.

As shown in FIGS. 1, 2, and 4, the movable contact arms 110 of the movable contact assembly 100 have an axis of a rotation 124. The axis of a rotation 124 extends generally perpendicularly with respect to the first and second carrier members 102,104 of the carrier assembly 101. More specifically, the movable contact arms 110 pivot clockwise and counterclockwise (from the perspective of FIGS. 1 and 2) about a pivot pin 132, which extends through a corresponding aperture 134 (FIG. 2) in each of the movable contact arms 110. The contact spring assembly 300 is coupled to the movable contact assembly 100, in the manner previously discussed, at a location which is above and behind the axis of rotation 124. This location, which is proximate the second ends 114 of the movable contact arms 110 of the movable contact assembly 100, provides the springs 312 of the contact spring assembly 300 with a mechanical advantage by placing them at a location (e.g., above and behind) which facilitates pivotal movement of the movable contact arms 110 about the aforementioned axis of a rotation 124. More specifically, the second end 114 of each movable contact arm 110 includes a cam profile 122 (FIGS. 2-4). In operation, the roller cam element 330 (FIGS. 2-4) of each slider 310 (FIGS. 2, 4, 5, 6A and 6B) of the contact spring assembly 300 (FIGS. 1, 2, 4, 5, 6A and 6B) engages the cam profile 122 of a corresponding one of the movable contact arms 110. In turn, as shown in FIG. 3, the roller cam element 330 (shown in phantom line drawing in simplified form in FIG. 3) rolls along the cam profile 122 in the direction generally indicated by arrow 136 of FIG. 3 as it biases the second end 114 of the movable contact arm 110 in the direction generally indicated by arrow 138 of FIG. 3, causing the movable contact arm 110 to pivot clockwise (from the perspective of FIG. 3) about axis of rotation 124 as generally indicated by arrow 140 of FIG. 3. In this manner, movable electrical contact 130 of the movable contact arm 110 is pivoted toward electrical contact with stationary electrical contact 12 of the stationary contact assembly 10. It will be appreciated that the cam profile 122 could have any known or suitable shape in order to provide the desired movable contact arm 110 motion.

The example stationary contact assembly 10, which is shown in phantom line drawing in simplified form in FIG. 3, includes a first contact portion 14 which is engaged by movable electrical contact 130 on movable contact arm 110, as shown. It will, however, be appreciated that the stationary contact assembly 10 could have any known or suitable alternative configuration. For example and without limitation, it could further include a second contact portion 16, as shown in phantom line drawing in simplified form in FIG. 3. It will also be appreciated that the first end 112 of the movable contact arm 110 could include, for example, a toe portion 106 and a heel portion 108, with the movable electrical contact 130 being mounted on the heel portion 108, as shown. The movable electrical contact 130 at or about the heel portion 108 is movable into and out of electrical contact with the stationary electrical contact 12 of first contact portion 14 of the stationary contact assembly 10, and the toe portion 106 is movable into (not shown) and out of (as shown) electrical contact with the second contact portion 16 of the stationary contact assembly 10. This movable and stationary electrical contact interaction is commonly referred to in the art as a "heel-toe" contact configuration, and is generally well known. Thus, the contact spring assembly 300 facilitates movement of the movable contact assembly 100 which is controlled by the circuit breaker operating mechanism (shown in simplified form in FIG. 1), in any suitable well known manner.

Accordingly, the disclosed contact spring assembly 300 provides individualized spring force to each of the movable contact arms 110 in order to bias the movable electrical contacts 130 disposed thereon towards corresponding stationary electrical contacts 12 (FIG. 3) of the stationary contact assembly 10 (FIG. 3). At the same time, the contact spring assembly 300 comprises a unique design with a minimal number of parts, some of which are substantially identical and may be coupled together without the use of separate mechanical fasteners. Therefore, the complexity of the contact spring assembly 300 is minimized, thereby reducing the associated cost and difficulty of assembly thereof. Thus, through use of a reduced number of components, some of which are symmetric and therefore interchangeable, the contact spring assembly 300 is economical to manufacture, compact in size and configuration, and relatively easy to assemble. The contact spring assembly 300 also provides individualized biasing of the separate fingers or movable contact arms 110 of the movable contact assembly 100, and an improved mounting location which utilizes mechanical advantage to optimize the performance of the springs 312.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A contact spring assembly for an electrical switching apparatus including a movable contact assembly and a stationary contact assembly having a plurality of stationary electrical contacts, said movable contact assembly including a carrier assembly, a plurality of movable contact arms pivotably coupled to said carrier assembly, and a plurality of movable electrical contacts coupled to said movable contact arms and being movable into and out of electrical contact with said stationary electrical contacts of said stationary contact assembly, said contact spring assembly comprising:

a first contact spring housing member;

a second contact spring housing member coupled to said first contact spring housing member and being disposed opposite said first contact spring housing member;

a spring guide including a plurality of spring holes, said spring guide being coupled to at least one of said first contact spring housing member and said second contact spring housing member and being disposed between said first contact spring housing member and said second contact spring housing member;

a plurality of sliders;

a plurality of springs, each of said springs having a first end received by corresponding one of said spring holes of said spring guide) and a second end coupled to a corresponding one of said sliders;

wherein each of said springs and said corresponding one of said sliders coupled thereto is structured to individually bias a corresponding one of said movable contact arms of said movable contact assembly and a corresponding one of said movable electrical contacts coupled thereto towards engagement with a corresponding one of said stationary electrical contacts of said stationary contact assembly;

wherein said first contact spring housing member and said second contact spring housing member are substantially identical; and wherein said first contact spring housing member and said second contact spring housing member each comprise at least one protrusion and at least one aperture; and wherein said first contact spring housing member and said second contact spring housing member are positioned in order that said at least one protrusion of said first contact spring housing member engages said at least one aperture of said second contact spring housing member, and said at least one protrusion of said second contact spring housing member engages said at least one aperture of said first contact spring housing member, thereby securing said contact spring assembly together.

2. A contact spring assembly for an electrical switching apparatus including a movable contact assembly and a stationary contact assembly having a plurality of stationary electrical contacts, said movable contact assembly including a carrier assembly, a plurality of movable contact arms pivotably coupled to said carrier assembly, and a plurality of movable electrical contacts coupled to said movable contact arms and being movable into and out of electrical contact with said stationary electrical contacts of said stationary contact assembly, said contact spring assembly comprising:

a first contact spring housing member;

a second contact spring housing member coupled to said first contact spring housing member and being disposed opposite said first contact spring housing member;

a spring guide including a plurality of spring holes, said spring guide being coupled to at least one of said first contact spring housing member and said second contact spring housing member and being disposed between said first contact spring housing member and said second contact spring housing member;

a plurality of sliders;

a plurality of springs, each of said springs having a first end received by corresponding one of said spring holes of said spring guide, and a second end coupled to a corresponding one of said sliders;

wherein each of said springs and said corresponding one of said sliders coupled thereto is structured to individually bias a corresponding one of said movable contact arms of said movable contact assembly and a corresponding one of said movable electrical contacts coupled thereto towards engagement with a corresponding one of said stationary electrical contacts of said stationary contact assembly;

wherein said corresponding one of said sliders comprises a first end and a second end; wherein the first end of said corresponding one of said sliders is coupled to the second end of one of said springs; and wherein the second end of said corresponding one of said sliders comprises a cam element structured to engage and move said corresponding one of said movable contact arms of said movable contact assembly; and wherein said first contact spring housing member and said second contact spring housing member each include a plurality of elongated guide slots; wherein said corresponding one of said sliders further comprises a first side including a first protrusion and a second side including a second protrusion; and wherein said first protrusion of the first side of said corresponding one of said sliders and said second protrusion of the second side of said corresponding one of said sliders are structured to engage en opposing pair of said elongated guide slots of said first contact spring housing member and said second contact spring housing member, in order to guide said corresponding one of said sliders and said cam element towards engagement with said corresponding one of said movable contact arms.

3. A contact spring assembly for an electrical switching apparatus including a movable contact assembly and a stationary contact assembly having a plurality of stationary electrical contacts, said movable contact assembly including a carrier assembly, a plurality of movable contact arms pivotably coupled to said carrier assembly, and a plurality of movable electrical contacts coupled to said movable contact arms and being movable into and out of electrical contact with said stationary electrical contacts of said stationary contact assembly, said contact spring assembly comprising:

a first contact spring housing member;

a second contact spring housing member coupled to said first contact spring housing member and being disposed opposite said first contact spring housing member;

a spring guide including a plurality of spring holes, said spring guide being coupled to at least one of said first contact spring housing member and said second contact spring housing member and being disposed between said first contact spring housing member and said second contact spring housing member;

a plurality of sliders;

a plurality of springs, each of said springs having a first end received by corresponding one of said spring holes of said spring guide, and a second end coupled to a corresponding one of said sliders;

wherein each of said springs and said corresponding one of said sliders coupled thereto is structured to individually bias a corresponding one of said movable contact arms of said movable contact assembly and a corresponding one of said movable electrical contacts coupled thereto towards engagement with a corresponding one of said stationary electrical contacts of said stationary contact assembly;

wherein said first contact spring housing members and said second contact spring housing member each include a first end and a second end; wherein the first end comprises a folded tab including a protrusion, and an unfolded tab having an aperture; wherein the second end comprises a pair of lateral protrusions; wherein said protrusion of said folded tab of the first end of said first contact spring housing member engages said aperture of said unfolded tab of the first end of said second contact spring housing member, and said protrusion of said folded tab of the first end of said second contact spring housing member engages said aperture of said unfolded tab of the first end of said first contact spring housing member; wherein said carrier assembly comprises a first carrier member and a second carrier member; and wherein said pair of lateral protrusions of at least one of said first contact spring housing member and said second contact spring housing member are structured to engage said first carrier member of said cater assembly and said second carrier member, in order that said contact spring assembly is disposed between said first carrier member and said second carrier member of said carrier assembly.

4. The contact spring assembly of claim 3 wherein said first contact spring housing member and said second contact spring housing member each further include an intermediate portion having a pair of recesses; wherein said spring guide includes a first side having a first pair of protrusions and a second side having a second pair of protrusions; and wherein said first pair of protrusions of the first side of said spring guide engages said pair of recesses of said intermediate portion of one of said first contact spring housing member and said second contact spring housing member, and said second pair of protrusions of the second side of said spring guide engages said pair of recesses of said intermediate portion of the other one of said first contact spring housing member and said second contact spring housing member.

5. A movable contact assembly for an electrical switching apparatus including a stationary contact assembly having a plurality of stationary electrical contacts, said movable contact assembly comprising:

a first carrier member;

a second carrier member;

a plurality of movable contact arms pivotably coupled between said first carrier member and second carrier member;

a plurality of movable electrical contacts coupled to said movable contact arms and being movable into and out of electrical contact with said stationary electrical contacts of said stationary contact assembly;

a contact spring assembly comprising:

a first contact spring housing member, a second contact spring housing member coupled to said first contact spring housing member and being disposed opposite Mid first contact spring housing member, a spring guide including a plurality of spring holes, said spring guide being coupled to at least one of said first contact spring housing member and said second contact spring housing member, and being disposed between said first contact spring housing member and said second contact spring housing member, a plurality of sliders, a plurality of springs, each of said springs having a first end received by a corresponding one of said spring holes of said spring guide, and a second end coupled to a corresponding one of said sliders, wherein each of said springs and said corresponding one of said sliders coupled thereto individually biases a corresponding one of said movable contact arms of said movable contact assembly and a corresponding one of said movable electrical contacts coupled thereto towards engagement with a corresponding one of said stationary electrical contacts of said stationary contact assembly;

wherein said first contact spring housing member and said second contact spring housing member are substantially identical; and wherein said first contact spring housing member and said second contact spring housing member each comprise at least one protrusion and at least one aperture; and wherein said first contact spring housing member and said second contact spring housing member are positioned in order that said at least one protrusion of said first contact spring housing member engages said at least one aperture of said second contact spring housing member, and said at least one protrusion of said second contact spring housing member engages said at least one aperture of said first contact spring housing member, thereby securing said contact spring assembly together.

6. A movable contact assembly for an electrical switching apparatus including a stationary contact assembly having a plurality of stationary electrical contacts, said movable contact assembly comprising:

a first carrier member;

a second carrier member;

a plurality of movable contact arms pivotably coupled between said first carrier member and second carrier member;

a plurality of movable electrical contacts coupled to said movable contact arms and being movable into and out of electrical contact with said stationary electrical contacts of said stationary contact assembly;

a contact spring assembly comprising:

a first contact spring housing member, a second contact spring housing member coupled to said first contact spring housing member and being disposed opposite said first contact spring housing member, a spring guide including a plurality of spring holes, said spring guide being coupled to at least one of said first contact spring housing member and said second contact spring housing member, and being disposed between said first contact spring housing member and said second contact spring housing member, a plurality of sliders, a plurality of springs, each of said springs having a first end received by a corresponding one of said spring holes of said spring guide, and a second end coupled to a corresponding one of said sliders, wherein each of said springs and said corresponding one of said sliders coupled thereto individually biases a corresponding one of said movable contact arms of said movable contact assembly and a corresponding one of said movable electrical contacts coupled thereto towards engagement with a corresponding one of said stationary electrical contacts of said stationary contact assembly wherein said corresponding one of said movable contact arms includes a first end and a second end; wherein the first end of said corresponding one of said movable contact arms carries one of said movable electrical contacts; wherein the second end of said corresponding one of said movable contact arms has a profile; wherein said corresponding one of said sliders comprises a first end and a second end; wherein the first end of said corresponding one of said sliders is coupled to the second end of one of said springs; wherein the second end of said corresponding one of said sliders comprises a corn element; and wherein said cam element engages said profile of the second end of said corresponding one of said movable contact arms of said movable contact assembly in order to bias said one of said movable electrical contacts towards a corresponding one of said stationary electrical contacts; and wherein said first contact spring housing member and said second contact spring housing member each include a plurality of elongated guide slots; wherein said corresponding one of said sliders further comprises a first side including a first protrusion and a second side including a second protrusion; and wherein said first protrusion of the first side of said corresponding one of said sliders and said second protrusion of the second side of said corresponding one of said sliders are structured to engage an opposing pair of said elongated guide slots of said first contact spring housing member and said second contact spring housing member, in order to guide said corresponding one of said sliders and said cam element towards engagement with said corresponding one of said movable contact arms.

7. A movable contact assembly for an electrical switching apparatus including a stationary contact assembly having a plurality of stationary electrical contacts, said movable contact assembly comprising:

a first carrier member;

a second carrier member;

a plurality of movable contact arms pivotably coupled between said first carrier member and second carrier member a plurality of movable electrical contacts coupled to said movable contact arms and being movable into and out of electrical contact with said stationary electrical contacts of said stationary contact assembly;

a contact spring assembly comprising:

a first contact spring housing member, a second contact spring housing member coupled to said first contact spring housing member and being disposed opposite said first contact spring housing member, a spring guide including a plurality of spring holes, said spring guide being coupled to at least one of said first contact spring housing member and said second contact spring housing member, and being disposed between said first contact spring housing member and said second contact spring housing member, a plurality of sliders, a plurality of springs, each afraid springs having a first end received by a corresponding one of said spring boles of said spring guide, and a second end coupled to a corresponding one of said sliders, wherein each of said springs and said corresponding one of said sliders coupled thereto individually biases a corresponding one of said movable contact antis afraid movable contact assembly and a corresponding one of said movable electrical contacts coupled thereto towards engagement with a corresponding one afraid stationary electrical contacts of said stationary contact assembly; and wherein said first contact spring housing member and said second contact spring housing member each include a first end, a second end, and an intermediate portion; wherein the first end comprises a folded tab including a protrusion, and an unfolded tab having an aperture; wherein the second end comprises a pair of lateral protrusions; wherein said intermediate portion comprises a pair of recesses; wherein said protrusion of said folded tab of the first end of said first contact spring housing member engages said aperture of said unfolded tab of the first end of said second contact spring housing member, and said protrusion of said folded tab of the first end of said second contact spring housing member engages said aperture of said unfolded tab of the first end of said first contact spring housing member; wherein said first carrier member and and second carrier member each include a recess; wherein said pair of lateral protrusions of one of said first contact spring housing member and said second contact spring housing member engage said recess of said first carrier member and said recess of said second carrier member, in order that said contact spring assembly is disposed between and coupled to said first carrier member and said second carrier member without requiring the use of separable mechanical fasteners; wherein said spring guide includes a first side having a first pair of protrusions and a second side having a second pair of protrusions; and wherein said first pair of protrusions of the first side of said spring guide engage said pair of recesses of said intermediate portion of one of said first contact spring housing member and said second contact spring housing member, and said second pair of protrusions of the second side of said spring guide engage said pair of recesses of said intermediate portion of the other one of said first contact spring housing member and said second contact spring housing member.

8. An electrical switching apparatus comprising:

a stationary contact assembly including a plurality of stationary electrical contacts; and a movable contact assembly comprising:

a first carrier member, a second carrier member, a plurality of movable contact arms pivotably coupled between said first carrier member and second carrier member, a plurality of movable electrical contacts coupled to said movable contact arms and being movable into and out of electrical contact with said stationary electrical contacts of said stationary contact assembly, a contact spring assembly comprising:

a first contact spring housing member, a second contact spring housing member coupled to said first contact spring housing member, and being disposed opposite said first contact spring housing member, a spring guide including a plurality of spring holes, said spring guide being coupled to at least one of said first contact spring housing member and said second contact spring housing member, and being disposed between said first contact spring housing member and said second contact spring housing member, a plurality of sliders.

a plurality of springs, each of said springs having a first end received by a corresponding one of said spring holes of said spring guide, and a second end coupled so a corresponding one of said sliders, wherein each of said springs and said corresponding one of said sliders coupled thereto individually biases a corresponding one of said movable contact arms of said movable contact assembly and a corresponding one of said movable electrical contacts coupled thereto towards engagement with a corresponding one of said stationary electrical contacts of said stationary contact assembly;

wherein said first contact spring housing member and said second contact spring housing member are substantially identical; and wherein said first contact spring housing member and said second contact spring housing member each comprise at least one protrusion and at least one aperture; and wherein said first contact spring housing member and said second contact spring housing member are positioned in order that said at least one protrusion of said first contact spring housing member engages said at least one aperture of said second contact spring housing member, and said at least one protrusion of said second contact spring housing member engages said at least one aperture of said first contact spring housing member, thereby securing said contact spring assembly together.

9. An electrical switching apparatus comprising:

a stationary contact assembly including a plurality of stationary electrical contacts; and a movable contact assembly comprising:

a first carrier member, a second carrier member, a plurality of movable contact arms pivotably coupled between said first carrier member and second carrier member, a plurality of movable electrical contacts coupled to said movable contact arms and being movable into and out of electrical contact with said stationary electrical contacts of said stationary contact assembly, a contact spring assembly comprising:

a first contact spring housing member, a second contact spring housing member coupled to said first contact spring housing member, and being disposed opposite said first contact spring housing member, a spring guide including a plurality of spring holes, said spring guide being coupled to at least one of said first contact spring housing member and said second contact spring housing member, and being disposed between said first contact spring housing member and said second contact spring housing member, a plurality of sliders, a plurality of springs, each of said springs having a first end received by a corresponding one of said spring holes of said spring guide, and a second end coupled to a corresponding one of said sliders, wherein each of said springs and said corresponding one of said sliders coupled thereto individually biases a corresponding one of said movable contact arms of said movable contact assembly and a corresponding one of said movable electrical contacts coupled thereto towards engagement with a corresponding one of said stationary electrical contacts of said stationary contact assembly;

wherein said corresponding one of said contact anus includes a first end and a second end; wherein the first end of said corresponding one of said movable contact arms carries one of said movable electrical contacts; wherein the second end of said corresponding one of said movable contact arms has a profile; wherein said corresponding one of said sliders comprises a first end and a second end; wherein the first end of said corresponding one of said sliders is coupled to the second end of one of said springs; wherein the second end of said corresponding one of said sliders comprises a cant element and wherein said cam element engages said profile of the second end of said corresponding one of said movable contact arms of said movable contact assembly in order to bias said one of said movable electrical contacts towards a corresponding one of said stationary electrical contacts; and wherein said first contact spring housing member and said second contact spring housing member each include a plurality of elongated guide slots; wherein said corresponding one of said sliders further comprises a first side including a first protrusion and a second aide including a second protrusion; and wherein said first protrusion of the first side of said corresponding one of said sliders and said second protrusion of the second side of said corresponding one of said sliders are structured to engage an opposing pair of said elongated guide slots of said first contact spring housing member and said second contact spring housing member, in order to guide said corresponding one of said sliders and said cam element towards engagement with said corresponding one of said movable contact arms.

10. An electrical switching apparatus comprising:

a stationary contact assembly including a plurality of stationary electrical contacts; and a movable contact assembly comprising:

a first carrier member, a second carrier member, a plurality of movable contact arms pivotably coupled between said first carrier member and second carrier member, a plurality of movable electrical contacts coupled to said movable contact arms and being movable into and out of electrical contact with said stationary electrical contacts of said stationary contact assembly, a contact spring assembly comprising:

a first contact spring housing member, a second contact spring housing member coupled to said first contact spring housing member, and bring disposed opposite said first contact spring housing member, a spring guide including a plurality of spring holes, said spring guide being coupled to at least one of said first contact spring housing member and said second contact spring housing member, and being disposed between said first contact spring housing member and said second contact spring housing member, a plurality of sliders, a plurality of springs, each of said springs having a first end received by a corresponding one of said spring holes of said spring guide, and a second end coupled to a corresponding one of said sliders, wherein each of said springs and said corresponding one of said sliders coupled thereto individually biases a corresponding one of said movable contact arms of said movable contact assembly and a corresponding one of said movable electrical contacts coupled thereto towards engagement with a corresponding one of said stationary electrical contacts of said stationary contact assembly; and wherein said first contact spring housing member and said second contact spring housing member each include a first end, a second end, and an intermediate portion; wherein the first end comprises a folded tab including a protrusion, and an unfolded tab having an aperture; wherein the second end comprises a pair of lateral protrusions; wherein said intermediate portion comprises a pair of recesses; wherein said protrusion of said folded tab of the first end of said first contact spring housing member engages said aperture of said unfolded tab of the first end of said second contact spring housing member, and said protrusion of said folded tab of the first end of said second contact spring housing member engages said aperture of said unfolded tab of the first end of said first contact spring housing member; wherein said first carrier member and said second carrier member each include a recess; wherein said pair of lateral protrusions of one of said first contact spring housing member and said second contact spring housing member engage said recess of said first carrier member and said recess of said second carrier member, in order that said contact spring assembly is disposed between and coupled to said first carrier member and said second carrier member without requiring the use of separable mechanical fasteners: wherein said spring guide includes a first side having a first pair of protrusions and a second side having a second pair of protrusions; and wherein said first pair of protrusions of the first side of said spring guide engage said pair of recesses of said intermediate portion of one of said first contact spring housing member and said second contact spring housing member, and said second pair of protrusions of the second side of said spring guide engage said pair of recesses of said intermediate portion of the other one of said first contact spring housing member and said second contact spring housing member.

* * * * *